US010283940B1

(12) United States Patent
Friery et al.

(10) Patent No.: US 10,283,940 B1
(45) Date of Patent: May 7, 2019

(54) DIELECTRIC GROUND STRAP FOR SPARK IMPROVEMENT

(71) Applicants: DENSO International America, Inc., Southfield, MI (US); DENSO CORPORATION, Kariya, Aichi-pref. (JP)

(72) Inventors: Blaise Friery, Farmington Hills, MI (US); Nicholas Polcyn, Commerce, MI (US)

(73) Assignees: DENSO International America, Inc., Southfield, MI (US); DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 15/936,732

(22) Filed: Mar. 27, 2018

(51) Int. Cl.
*H01T 13/32* (2006.01)

(52) U.S. Cl.
CPC ..... *H01T 13/32* (2013.01)

(58) Field of Classification Search
USPC ..... 123/169 EL, 169 R
See application file for complete search history.

(56) References Cited

U.S. PATENT DOCUMENTS

| | | | | |
|---|---|---|---|---|
| 4,439,707 | A * | 3/1984 | Hattori | H01T 13/39 313/130 |
| 4,540,912 | A | 9/1985 | Matesco | |
| 4,906,889 | A * | 3/1990 | Dibert | H01T 13/32 313/126 |
| 5,514,314 | A | 5/1996 | McDougal | |
| 2007/0188063 | A1 | 8/2007 | Lykowski | |
| 2007/0262721 | A1 | 11/2007 | Camilli | |
| 2011/0126789 | A1 * | 6/2011 | Suwa | F02P 11/02 123/169 R |

* cited by examiner

*Primary Examiner* — Ashok Patel
(74) *Attorney, Agent, or Firm* — Harness, Dickey & Pierce, P.L.C.

(57) ABSTRACT

A spark plug includes a housing, a center electrode disposed within the housing, and a ground electrode cooperating with the center electrode to generate a spark. The ground electrode further includes an arm having a main body and a base, a pad fixed to the base, and a covering affixed to at least one of the main body and the base. The main body is fixed to the housing. The covering alters a dielectric constant of the main body or a dielectric constant of the base to create a difference in the dielectric constant of the main body and the dielectric constant of the base and focus the spark on the pad.

14 Claims, 6 Drawing Sheets

DIELECTRIC GROUND STRAP FOR SPARK IMPROVEMENT

FIELD

The present disclosure relates to spark plugs, and, specifically, to a dielectric ground strap for spark plugs.

BACKGROUND

This section provides background information related to the present disclosure which is not necessarily prior art.

Spark plugs often include a housing having a copper core and center electrode disposed within. A ground strap extends from the housing and includes a ground electrode on its tip. A gap exists between the ground electrode and the center electrode. Spark plugs work by generating a high potential difference between the center electrode and the ground electrode. When the potential difference gets high enough, a spark is formed which ignites a fuel-air mixture.

SUMMARY

This section provides a general summary of the disclosure, and is not a comprehensive disclosure of its full scope or all of its features.

An example spark plug according to the present disclosure includes a housing, a center electrode, and a ground electrode. The center electrode is disposed within the housing, and the ground electrode cooperates with the center electrode to generate a spark. The ground electrode further includes an arm, a pad, and a covering. The arm has a main body and a base, where the main body is fixed to the housing. The covering is fixed to at least one of the main body and the base, and the covering alters a dielectric strength of the main body or a dielectric strength of the base to create a difference in the dielectric constant (or relative permittivity) of the main body and the dielectric constant (or relative permittivity) of the base and focus the spark on the pad (i.e., increase the "willingness" of the electrons to jump the gap to the pad, or other specific part, of the spark plug).

The covering of the spark plug may be a surface treatment or coating of the main body that increases the dielectric strength of the main body.

The covering of the spark plug may be a nonconductive material.

The covering of the spark plug may be one of a ceramic, a polymer, an acrylic, a para-aramid synthetic fiber, a polystyrene, a polytetrafluoroethylene, a polyvinyl chloride, a Bakelite, a nylon, a fused quartz, and an aluminum oxide.

The covering of the spark plug may be a sleeve covering at least a portion of said main body of said arm.

The sleeve may be a nonconductive material.

The sleeve may cover an entirety of the main body.

The sleeve may cover an upper portion of the main body nearest the housing.

The sleeve may cover a lower portion of the main body nearest the base.

The covering of the spark plug may be a conductive coating on the base that decreases the dielectric strength the base.

The covering of the spark plug may be a conductive coating that is a high temperature precious metal.

The covering of the spark plug may be a conductive coating that is a surface treatment on the base that decreases the dielectric strength of the base.

The surface treatment may be one of a series of bumps, grooves, etches, or scratches.

An example ground electrode assembly for a spark plug according to the present disclosure includes an arm, a pad, and a covering. The arm includes a main body and a base, where the pad is fixed to the base. The covering is fixed to at least one of the main body and the base and alters a dielectric strength of the main body or the base to create a difference in the dielectric constants (or relative permittivity) of the main body and the base and focus a generated spark on the pad (i.e., increase the "willingness" of the electrons to jump the gap to the pad, or other specific part, of the spark plug).

The covering for the ground electrode assembly may be a surface treatment or coating of the main body that increases the dielectric strength of the main body. The dielectric strength of the covering may be greater than 3*10^6 V/m and the dielectric strength of the base may be within a range of 0 V/m to 3*10^6 V/m.

The covering for the ground electrode assembly may be a sleeve covering at least a portion of the main body of the arm. The sleeve may have a dielectric strength greater than 3*10^6 V/m.

The covering for the ground electrode assembly may be disposed on the base of the arm. The covering may further be a coating having a dielectric strength less than 3*10^6 V/m and having a conductivity greater than 18.7*10^6 S/m.

The covering for the ground electrode assembly may be a high temperature precious metal.

The covering for the ground electrode assembly may be disposed on the base of the arm and may be a surface treatment that decreases the dielectric strength of the base to less than 3*10^6 V/m.

The covering for the ground electrode assembly may be one of a series of bumps, grooves, etches, or scratches.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
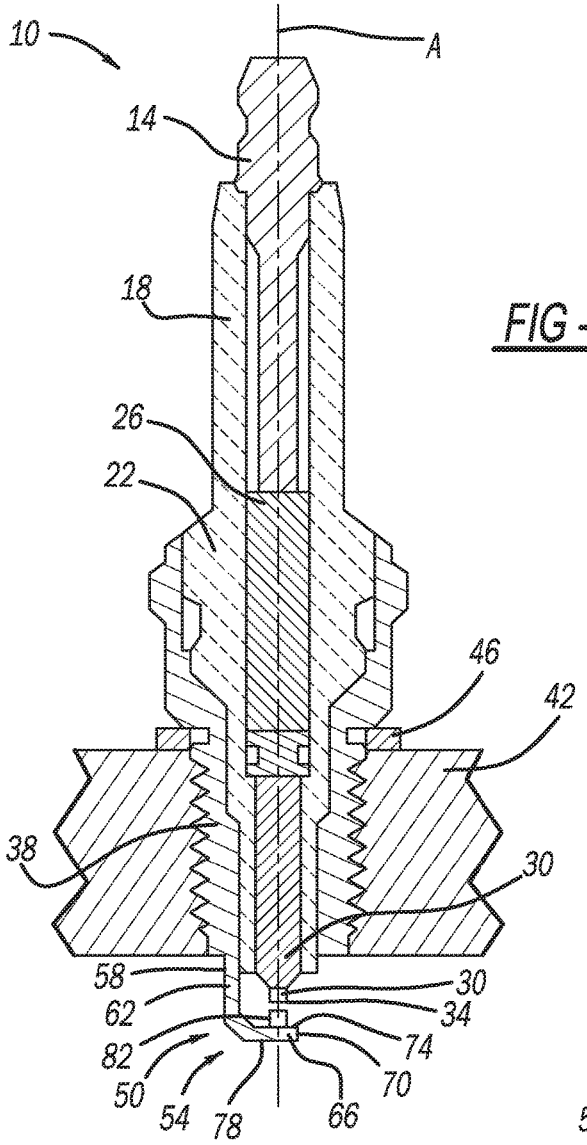
FIG. 1 illustrates a spark plug having a ground electrode assembly according to the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

In current spark plug designs, turbulence in the combustion chamber often stretches the spark, increasing the surface area of plasma discharge. However, due to factors such as turbulence or sub-optimal electrode orientation, the spark shorts into the ground electrode strap and the ignition reliability can decrease due to the decreased surface area of the spark size.

The present disclosure relates to a spark plug that minimizes the chance of the spark shorting into the ground electrode strap and housing, thereby increasing the combustion reliability in the combustion chamber. The spark plug of the present disclosure further creates a concentrated ionization energy field around the spark plug gap which can improve ignition by maintaining a stronger electromagnetic field between the center electrode and the ground electrode and decreasing breakdown energy required for a spark event.

The spark plug of the present disclosure achieves these benefits by having a ground electrode tip with a much lower dielectric constant (or relative permittivity) than the ground electrode strap and housing. The high difference in dielectric constants (or relative permittivity) minimizes the chance that the spark will short into the upper portion of the ground strap or housing instead of stretch (i.e., the high difference in dielectric constants increases the "willingness" of the electrons to jump the gap to the pad, or other specific part, of the spark plug). In addition, the dielectric barrier may concentrate the ion field between the center electrode and the ground electrode making it easier for the spark to form. In general, throughout the specification, where the dielectric strength is increased, the dielectric constant is decreased. A lower dielectric constant means the part is less conductive and has higher dielectric strength, while a higher dielectric constant means that part is more conductive and lower dielectric strength.

One embodiment of the spark plug includes a sleeve or surface treatment on the exterior of the ground strap that makes the ground strap nonconductive and is resistant to carbon fowling or carbon build up. By including the nonconductive sleeve or surface treatment, the ground strap has a much higher dielectric strength (and much lower dielectric constant) than the ground electrode tip.

Another embodiment of the spark plug includes a sleeve that covers a portion of the ground strap. The sleeve may be formed of a low conductivity or nonconductive material, thereby creating a low conductivity or nonconductive surface on a portion of the ground strap. By including the low conductivity or nonconductive sleeve, the portion of the ground strap with the sleeve has a much higher dielectric strength (and much lower dielectric constant) than the ground electrode tip.

Another embodiment of the spark plug involves treating the ground electrode tip with a surface treatment that increases the conductivity, encouraging the spark to stay in the desired region. The surface treatment could be a chemical coating or physical marring (such as a series of bumps, grooves, etches, scratches, etc.) By increasing the conductivity of the ground electrode tip, the ground electrode tip has a much lower dielectric strength (and much higher dielectric constant) than the ground electrode strap and housing.

The difference in dielectric strengths (or dielectric constants) in the above three examples minimizes the chance that the spark will short into the upper portion of the ground strap or housing instead of stretch. In addition, the dielectric barrier may concentrate the ion field between the center electrode and the ground electrode making it easier for the spark to form. The above embodiments are not mutually exclusive and could be either practiced alone or in combination.

Now referring to FIG. 1, a spark plug 10 in accordance with the present teachings is illustrated. The spark plug 10 can be any suitable spark plug for use with any suitable engine. For example, the engine may be any suitable vehicle engine. The vehicle engine may be for a passenger vehicle, mass transit vehicle, military vehicle, construction vehicle, aircraft, watercraft, etc. The spark plug may also be used with non-vehicular engines, such as generator engines or engines for other machinery, systems, equipment, etc.

The spark plug 10 generally includes a terminal 14 surrounded by an insulator 18, which includes an inside housing portion 22. The terminal 14 extends along a longitudinal axis A of the spark plug 10 to a glass seal 26. Also extending along the longitudinal axis A is a center electrode 30, which has a center electrode tip 34. The longitudinal axis A extends generally through a center of the tip 34. Surrounding the center electrode 30 is a housing 38. The housing 38 is configured to be mounted to an engine head 42 in any suitable manner. The engine head 42 can be an engine head of any suitable engine. Extending around the housing 38 is a gasket 46.

Figure 2:
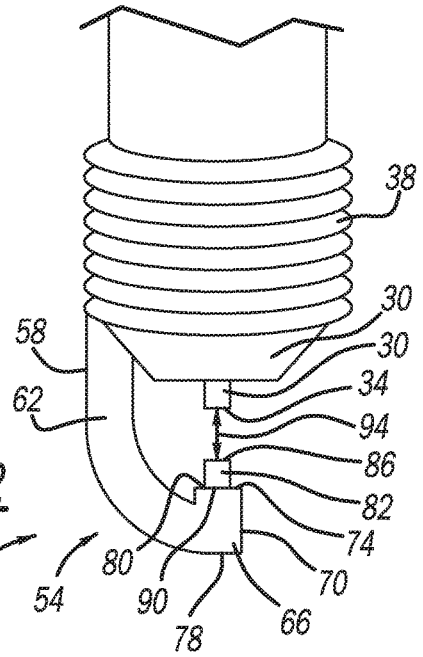
FIG. 2 illustrates the ground electrode assembly of FIG. 1.

With continued reference to FIG. 1, and additional reference to FIG. 2, the spark plug 10 further includes a spark plug ground electrode assembly 50, which has a ground electrode 54 according to the present disclosure. The ground electrode 54 includes an arm 58 having a main body section 62 and a ground electrode base 66. The ground electrode base 66 is at, or adjacent to; an end surface 70 of the ground electrode 54. The ground electrode base 66 includes an inner surface 74 and an outer surface 78. The inner surface 74 faces the center electrode 30, and the outer surface 78 is opposite to the inner surface 74. The ground electrode 54 can be made of any suitable material, such as a nickel alloy.

Secured to the ground electrode base 66 is a ground electrode pad 82. The ground electrode pad 82 may be secured by any method, such as, in part, by a weld 80. The ground electrode pad 82 includes a pad head surface 86 and a pad base surface 90, which is opposite to the pad head surface 86. The ground electrode pad 82 can be made of any suitable material, such as any suitable precious metal, such as platinum.

A gap 94 exists between the ground electrode pad 82 and the center electrode 30. In operation, a high potential difference is generated between the center electrode 30 and the ground electrode pad 82. When the potential difference reaches a breakdown threshold, a spark is formed which ignites a fuel-air mixture within and surrounding the gap 94.

The breakdown threshold may be dependent on a number of factors and may be calculated using Paschen's Law:

$$V_b = \frac{B \cdot p \cdot d}{\ln(A \cdot p \cdot d) - \ln\left(\ln\left(1 + \frac{1}{\gamma_{se}}\right)\right)}$$

where B is a constant depending on a surrounding gas (V/atm*m), ρ is a pressure of the surrounding gas (atm), d is a gap distance (m), A is a constant that depends on the surrounding gas (1/atm*m), and $\gamma_{60}$ is a secondary electron emission coefficient.

Figure 3A:
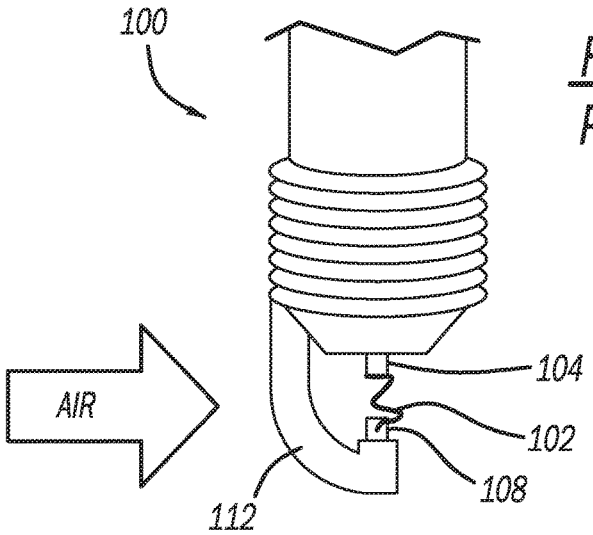
FIG - 3A Prior Art
FIGS. 3A-3B illustrate spark stretching caused by turbulence in a combustion chamber.
Figure 3B:
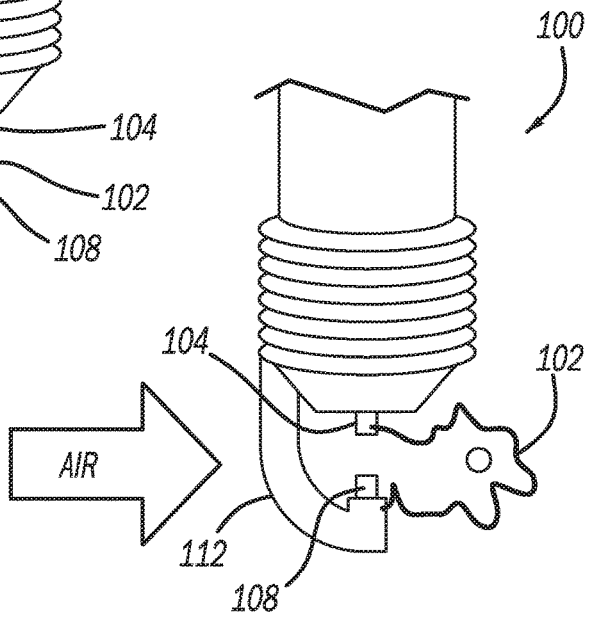
FIG - 3B Prior Art

With Reference to FIGS. 3A and 3B, turbulence (either tumble or swirl) is introduced into the combustion chamber to mix the air and fuel for combustion. In previous spark plug designs 100, when a spark 102 is formed between a center electrode 104 and a ground electrode pad 108, the turbulence (shown as air flow in the figures) often stretches the spark 102, increasing the surface area of plasma discharge. The stretch of the spark 102 is often a positive effect, allowing the spark 102 to access a greater surface area of the fuel-air mixture and leading to a more complete or thorough burn (and increased ignition reliability) of the fuel in the fuel-air mixture.

Figure 4A:
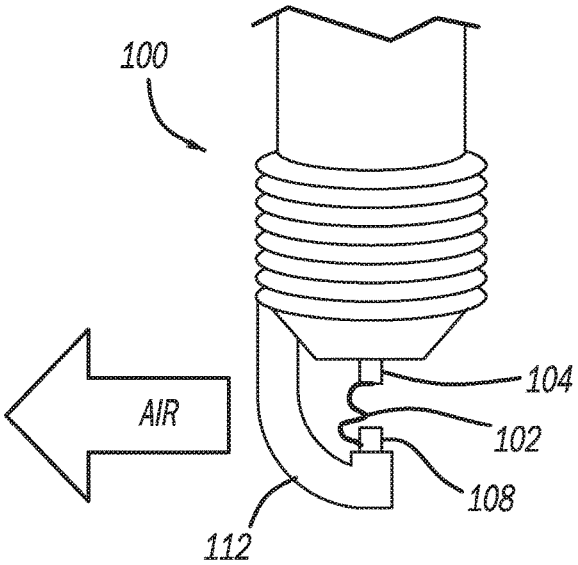
FIG - 4A Prior Art
FIGS. 4A-4C illustrate spark shorting on a ground strap or arm.
Figure 4B:
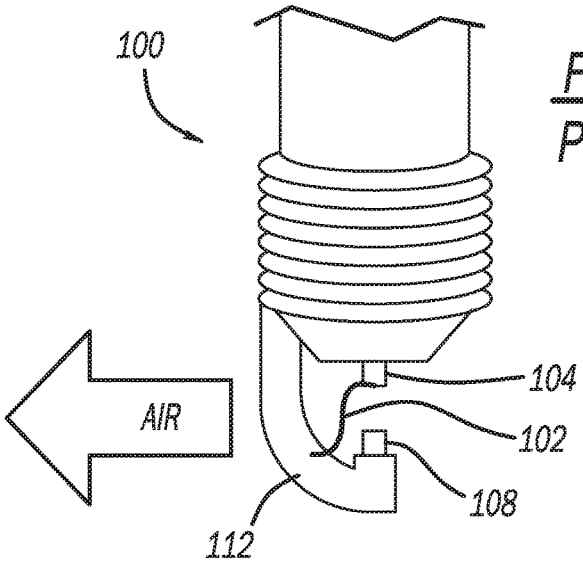
FIG - 4B Prior Art
Figure 4C:
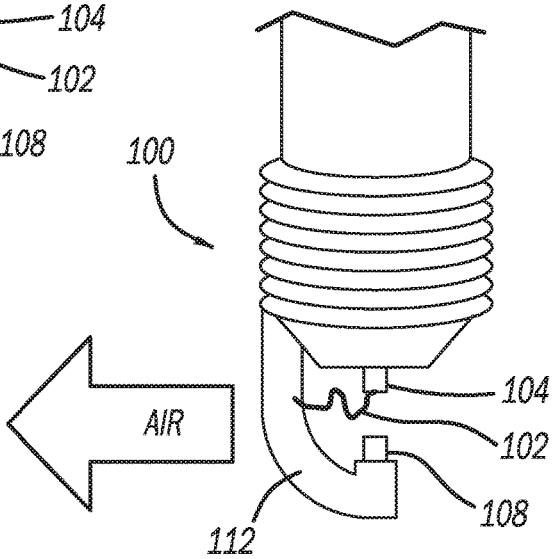
FIG - 4C Prior Art

However, with reference to FIGS. 4A-4C, in occurrences of poor turbulence or sub-optimal spark plug orientation (i.e., the spark plug is oriented such that the air flow pushes the spark into an arm 112), the spark 102 may short into the arm 112. For example, when the spark 102 is formed between the center electrode 104 and the ground electrode pad 108, the turbulence may push the spark 102 up the arm, or strap, 112 of the ground electrode, causing the spark 102 to short into the arm 112. As is shown in FIGS. 4B and 4C, as the spark 102 shorts into the arm 112, the surface area of the spark size decreases, leading to decreased ignition reliability.

Referring again to FIGS. 1 and 2, the spark plug 10 of the present disclosure solves the issue illustrated in FIGS. 4A-4C by including a ground electrode base 66 with a lower dielectric strength (and a higher dielectric constant) than the ground electrode arm or strap 58 and housing 38. Detailed examples of the spark plug in FIGS. 1 and 2 are illustrated in FIGS. 7-10B.

Figure 5:
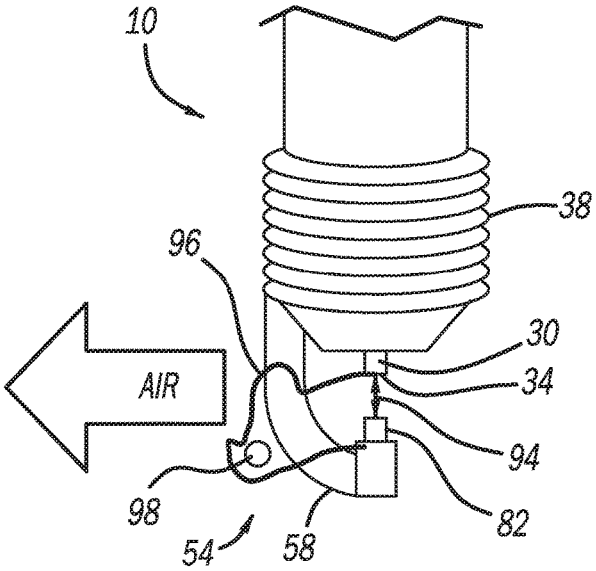
FIG. 5 illustrates the ground electrode assembly of FIG. 1 with spark stretching caused by turbulence in a combustion chamber.

The spark plug 10 minimizes the chance of a spark 96 shorting into the ground electrode arm, or strap, 58 and housing 38, thereby increasing the combustion reliability in the combustion chamber. As shown in FIG. 5, after the spark 96 jumps the gap 94, turbulence begins to stretch the spark 96 toward the ground electrode arm or strap 58. The higher dielectric strength (and a lower dielectric constant) of the arm 58 limits or prevents the spark 96 from shorting out on the arm 58, and a flame kernel 98 is able to form, leading to combustion of the air-fuel mixture.

Figure 6A:
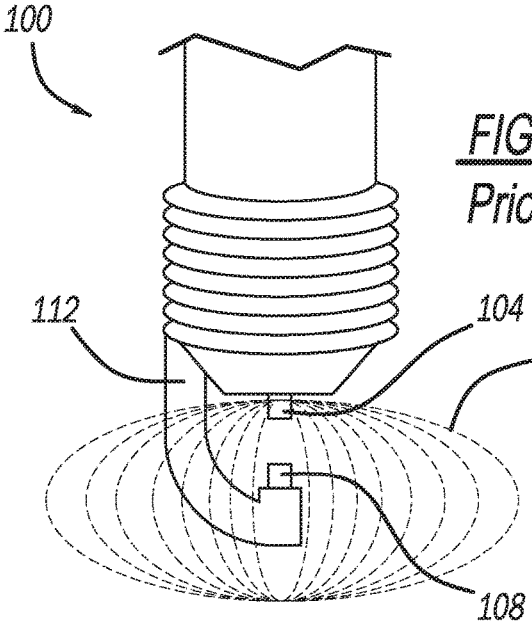
FIG - 6A Prior Art
FIG. 6A illustrates an ion cloud.
Figure 6B:
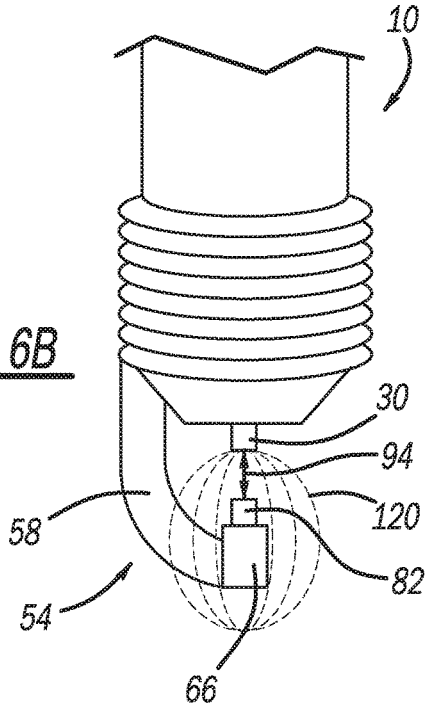
FIG. 6B illustrates an ion cloud formed on the ground electrode assembly of FIG. 1.

The spark plug 10 further creates a concentrated ionization energy field around the spark plug gap 94 which can improve ignition by maintaining a stronger electromagnetic field between the center electrode 30 and the ground electrode 54 and decreasing breakdown energy required for a spark event. As shown in FIG. 6A, a consistent (or nearly consistent) dielectric strength for the entire ground electrode arm 112 (including the base), as in previous designs 100, promotes a large, high energy ion cloud 116. The high energy ion cloud 116 promotes spark breakdown and can lead to spark in an unintended area. In contrast, in FIG. 6B, the difference in the dielectric constant of the arm 58 versus the base 66 of the spark plug 10 of the present disclosure limits the size of the ion field, creating a concentrated ion cloud 120 and making it easier for spark to form.

Figure 7:
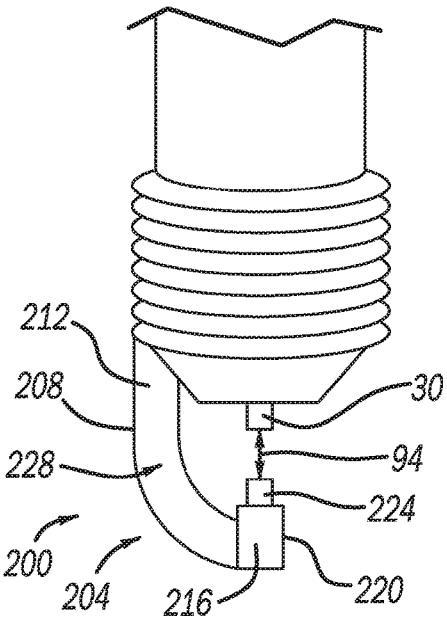
FIG. 7 illustrates an example ground electrode assembly according to the present disclosure.

FIG. 7 illustrates an example spark plug ground electrode assembly 200, which has a ground electrode 204, according to the present disclosure. The ground electrode 204 includes an arm, or ground strap, 208 having a main body section 212 and a ground electrode base 216. The ground electrode base 216 is at or adjacent to an end surface, or tip, 220 of the ground electrode 204. The ground electrode 204 can be made of any suitable material, such as, for example, a nickel alloy.

Secured to the ground electrode base 216 is a ground electrode pad 224. The ground electrode pad 224 cooperates with the center electrode 30 to generate a spark. The ground electrode pad 224 can be made of any suitable material, such as a platinum alloy or any other suitable precious metal.

The main body section 212 of the arm 208 may be treated with a coating 228 to decrease, or eliminate, the conductivity of the main body section 212. The coating 228 may be, for example, a surface treatment such as a ceramic, polymer, acrylic, para-aramid synthetic fiber (for example only, Kevlar®), polystyrene, polytetrafluoroethylene (for example only, Teflon®), polyvinyl chloride (PVC), Bakelite, nylon, fused quartz, aluminum oxide, or any other nonconductive coating or surface treatment that decreases the conductivity of the main body section 212. The coating 228 may be applied by dipping all or a portion of the main body section 212 of the arm 208 in a bath having the coating material such that the coating material is applied to the surface of the main body section 212. Other methods of application may include applying the coating material through an aerosol spray, or any other application method suitable for the individual coating material.

The coating 228 increases the dielectric strength (and decreases the dielectric constant) of the main body section 212, generating a difference in dielectric strength (or dielectric constant) between the main body section 212 and the base 216 having the pad 224. For example only, the dielectric strength of the coating 228 on the main body section 212 may be greater than 3*10^6 Volt/meter (V/m), or between 6.65*10^6 V/m and 60*10^6 V/m or greater, whereas the dielectric strength of the ground electrode base 216 may be less than or equal to, for example only, 3*10^6 V/m. The difference in the dielectric strengths (and dielectric constants) minimizes the chance of the spark shorting into the ground electrode arm 208 thereby increasing the combustion reliability in the combustion chamber. Further, the different dielectric strengths create a concentrated ionization energy field around the spark plug gap 94 which can improve ignition by maintaining a stronger electromagnetic field between the center electrode 30 and the ground electrode 204 and decreasing breakdown energy required for a spark event.

Figure 8:
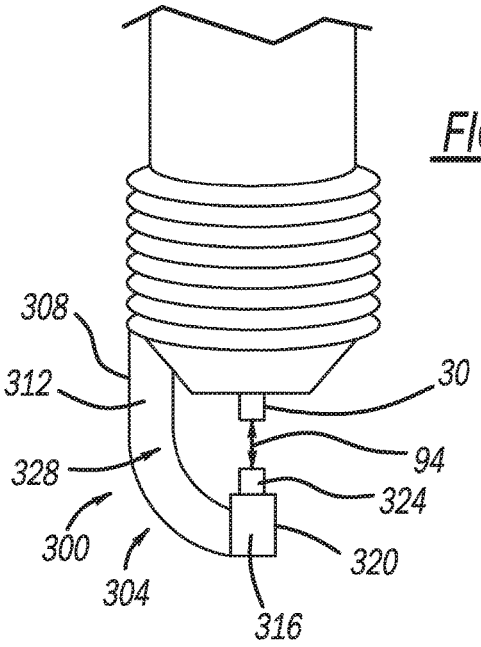
FIG. 8 illustrates another example ground electrode assembly according to the present disclosure.

Now referring to FIG. 8, another example spark plug ground electrode assembly 300 is shown. The spark plug ground assembly 300 includes a ground electrode 304 having an arm, or ground strap, 308 with a main body section 312 and a ground electrode base 316. The ground electrode base 316 is at or adjacent to an end surface, or tip, 320 of the ground electrode 304. The ground electrode 304 can be made of any suitable material, such as, for example, a nickel alloy.

Secured to the ground electrode base 316 is a ground electrode pad 324. The ground electrode pad 324 cooperates with the center electrode 30 to generate a spark. The ground electrode pad 324 can be made of any suitable material, such as, for example, a platinum alloy or any suitable precious metal.

A sleeve 328 may cover the main body section 312 of the arm (or ground strap) 308. The sleeve 328 may be formed of a nonconductive material, such as, for example ceramic, polymer, acrylic, para-aramid synthetic fiber (for example only, Kevlar®), polystyrene, polytetrafluoroethylene (for example only, Teflon®), polyvinyl chloride (PVC), Bakelite, nylon, fused quartz, aluminum oxide, or any other nonconductive material. As such, the sleeve 328 decreases, or eliminates, the conductivity of the main body section 312. The sleeve 328 may be applied during manufacturing by forming the nonconductive sleeve 328 directly on the arm 308 or by wrapping, or otherwise assembling, the sleeve on the main body 312 of the arm 308. In some embodiments, the main body 312 of the arm 308 may be a copper core surrounded by a nonconductive material extruded over the copper core as the sleeve 328. Thus, the sleeve 328 in these embodiments would be formed along with the forming of the arm 308 during manufacture of the spark plug 10.

The sleeve 328 increases the dielectric strength (and decreases the dielectric constant) of the main body section 312, generating a difference in dielectric strength (or dielectric constant) between the main body section 312 and the base 316 having the pad 324. For example only, the dielectric strength of the sleeve 328 on the main body section 312 may be greater than 3*10^6 V/m, or between 6.65*10^6 V/m and 60*10^6 V/m or greater, whereas the dielectric strength of the ground electrode base 316 may be less than or equal to, for example only, 3*10^6 V/m. The difference in the dielectric strengths (and dielectric constants) minimizes the chance of the spark shorting into the ground electrode arm 308, thereby increasing the combustion reliability in the combustion chamber. Further, the different dielectric strengths create a concentrated ionization energy field around the spark plug gap 94 which can improve ignition by maintaining a stronger electromagnetic field between the center electrode 30 and the ground electrode 304 and decreasing breakdown energy required for a spark event.

Figure 9A:
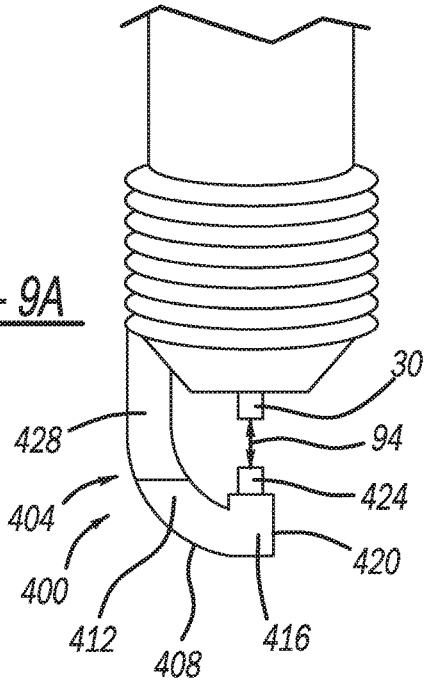
FIG. 9A illustrates another example ground electrode assembly according to the present disclosure.

Now referring to FIG. 9A, another example spark plug ground electrode assembly 400 is shown. The spark plug ground assembly 400 includes a ground electrode 404 having an arm, or ground strap, 408 with a main body section 412 and a ground electrode base 416. The ground electrode base 416 is at or adjacent to an end surface, or tip, 420 of the ground electrode 404. The ground electrode 404 can be made of any suitable material, such as, for example, a nickel alloy.

Secured to the ground electrode base 416 is a ground electrode pad 424. The ground electrode pad 424 cooperates with the center electrode 30 to generate a spark. The ground electrode pad 424 can be made of any suitable material, such as, for example, a platinum alloy or any suitable precious metal.

A sleeve or coating 428 may partially cover the main body section 412 of the arm (or ground strap) 408. The partial sleeve or coating 428 may be formed of a nonconductive material, such as, for example ceramic, polymer, acrylic, para-aramid synthetic fiber (for example only, Kevlar®), polystyrene, polytetrafluoroethylene (for example only, Teflon®), polyvinyl chloride (PVC), Bakelite, nylon, fused quartz, aluminum oxide, or any other nonconductive material. As such, the partial sleeve or coating 428 decreases, or eliminates, the conductivity of the portion of the main body section 412. The partial sleeve or coating 428 may be the same as the coating 228 or sleeve 328 previously discussed, only the partial sleeve or coating 428 only covers a portion of the arm 408. The partial sleeve or coating 428 may be applied in place of the coating 228 or sleeve 328 for ease of manufacture. For example only, if the arm 408 is secured by the base 416 and dipped in a surface treatment bath, only the portion of the arm 408 illustrated in FIG. 9A may be treated in the bath.

The partial sleeve or coating 428 increases the dielectric strength (and decreases the dielectric constant) of the portion of the main body section 412 which it covers, generating a difference in dielectric strength (and dielectric constant) between the portion of the main body section 412 and the base 416 having the pad 424. For example only, the dielectric strength of the partial sleeve or coating 428 on the main body section 412 may be greater than 3*10^6 V/m, or between 6.65*10^6 V/m and 60*10^6 V/m or greater, whereas the dielectric strength of the ground electrode base 416 may be less than or equal to, for example only, 3*10^6 V/m. The difference in the dielectric strengths (or dielectric constants) minimizes the chance of the spark shorting into the upper portion of the ground electrode arm 408, thereby increasing the combustion reliability in the combustion chamber. Further, the different dielectric strengths create a concentrated ionization energy field around the spark plug gap 94 which can improve ignition by maintaining a stronger electromagnetic field between the center electrode 30 and the ground electrode 404 and decreasing breakdown energy required for a spark event.

Figure 9B:
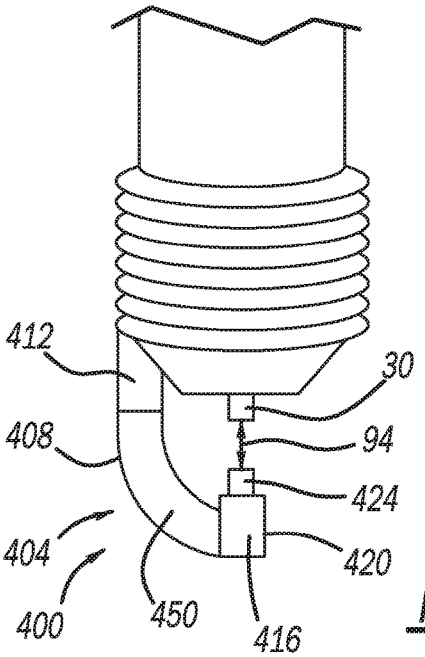
FIG. 9B illustrates another example ground electrode assembly according to the present disclosure.

In other embodiments, such as FIG. 9B, the partial sleeve or coating 428 may be a partial sleeve or coating 450 covering a different portion of the arm 408. Similar to the partial sleeve or coating 428, the partial sleeve or coating 450 may be formed of a nonconductive material, such as, for example ceramic, polymer, acrylic, para-aramid synthetic fiber (for example only, Kevlar®), polystyrene, polytetrafluoroethylene (for example only, Teflon®), polyvinyl chloride (PVC), Bakelite, nylon, fused quartz, aluminum oxide, or any other nonconductive material. As such, the partial sleeve or coating 450 decreases, or eliminates, the conductivity of the portion of the main body section 412 which it covers. The partial sleeve or coating 450 may be the same as the coating 228 or sleeve 328 previously discussed, only the partial sleeve or coating 450 only covers a portion of the arm 408. The partial sleeve or coating 450 may be applied in place of the coating 228 or sleeve 328 for ease of manufacture. For example only, if the spark plug 10 is secured by the housing 38 and dipped in a surface treatment bath, only the portion of the arm 408 illustrated in FIG. 9B may be treated in the bath.

The partial sleeve or coating 450 increases the dielectric strength (and decreases the dielectric constant) of the portion of the main body section 412 which it covers, generating a difference in dielectric strength (and dielectric constant) between the portion of the main body section 412 and the base 416 having the pad 424. For example only, the dielectric strength of the partial sleeve or coating 450 on the main body section 412 may be greater than 3*10^6 V/m, or between 6.65*10^6 V/m and 60*10^6 V/m or greater, whereas the dielectric strength of the ground electrode base 416 may be less than or equal to, for example only, 3*10^6 V/m. The difference in the dielectric strengths (and dielectric constants) minimizes the chance of the spark shorting into the upper portion of the ground electrode arm, or strap, 408, thereby increasing the combustion reliability in the combustion chamber. Further, the different dielectric strengths create a concentrated ionization energy field around the spark plug gap 94 which can improve ignition by maintaining a stronger electromagnetic field between the center electrode 30 and the ground electrode 404 and decreasing breakdown energy required for a spark event.

Figure 10A:
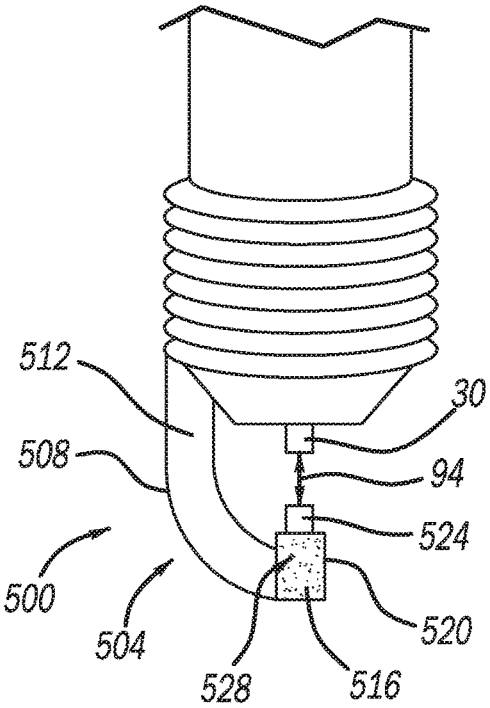
FIG. 10A illustrates another example ground electrode assembly according to the present disclosure.

Now referring to FIG. 10A, another example spark plug ground electrode assembly 500 is shown. The spark plug ground assembly 500 includes a ground electrode 504 having an arm, or ground strap, 508 with a main body section 512 and a ground electrode base 516. The ground electrode base 516 is at or adjacent to an end surface, or tip, 520 of the ground electrode 504. The ground electrode 504 can be made of any suitable material, such as, for example, a nickel alloy.

Secured to the ground electrode base 516 is a ground electrode pad 524. The ground electrode pad 524 cooperates with the center electrode 30 to generate a spark. The ground electrode pad 524 can be made of any suitable material, such as, for example, a platinum alloy or any suitable precious metal.

A coating or covering 528 may cover the ground electrode base 516. The coating or covering 528 may be formed of a conductive material, such as, for example platinum, silver, gold, copper, aluminum, molybdenum, any high temperature precious metal, or any other conductive material which enhances the conductivity of the base 516. The coating or covering 528 may be applied during manufacturing by dipping the base 516 in a surface treatment bath, by layering the coating or covering 528 directly on the base 516, or by any other method suitable for the particular coating or covering 528.

The coating or covering 528 decreases the dielectric strength (and increases the dielectric constant) of the base 516, generating a difference in dielectric strength (and dielectric constant) between the main body section 512 and the base 516. For example only, the dielectric strength of the main body section 512 may be approximately 3*10^6 V/m, whereas the dielectric strength of the covered (528) ground electrode base 516 may be less than 3*10^6 V/m and have a conductivity within a range of 18.7*10^6 Siemens/meter (S/m) to 62.1*10^6 S/m or greater. The difference in the dielectric strengths (or dielectric constants) decreases the chance of the spark shorting into the ground electrode arm 508, thereby increasing the combustion reliability in the combustion chamber. Further, the different dielectric strengths create a concentrated ionization energy field around the spark plug gap 94 which can improve ignition by maintaining a stronger electromagnetic field between the center electrode 30 and the ground electrode 504 and decreasing breakdown energy required for a spark event.

Figure 10B:
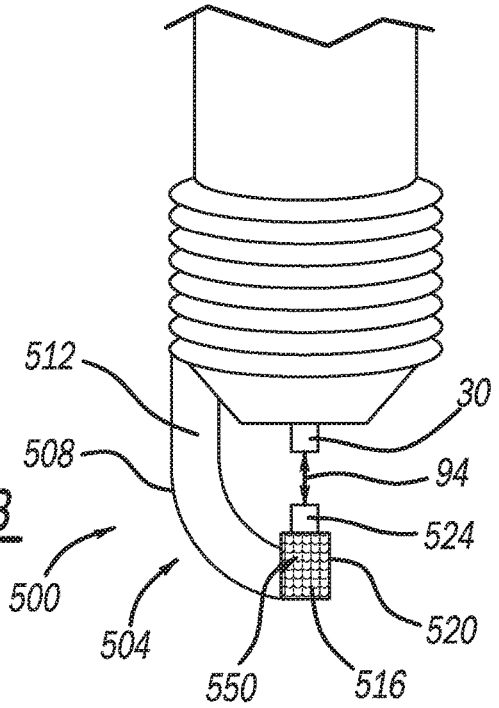
FIG. 10B illustrates another example ground electrode assembly according to the present disclosure.

In other embodiments, such as FIG. 10B, the coating or covering 528 may be a surface treatment 550 covering the ground electrode base 516. The surface treatment 550 may be, for example, a series of bumps, grooves, etches, scratches, or any other surface treatment that creates points of low dielectric resistance. As such, the surface treatment 550 decreases the dielectric strength (and increases the dielectric constant) of the ground electrode base 516. The surface treatment 550 may be applied directly to the base 516 during manufacturing through, for example, laser etching, impression, rough grinding, refraining from polishing, or any other method of applying the surface treatment.

The surface treatment 550 decreases the dielectric strength (and increases the dielectric constant) of the base 516, generating a difference in dielectric strength (and dielectric constant) between the main body section 512 and the base 516. For example only, the dielectric strength of the main body section 512 may be approximately 3*10^6 V/m, whereas the dielectric strength of the surface treated (550)

ground electrode base 516 may be less than 3*10^6 V/m. The difference in the dielectric strengths (and dielectric constants) decreases the chance of the spark shorting into the ground electrode arm 508, thereby increasing the combustion reliability in the combustion chamber. Further, the different dielectric strengths create a concentrated ionization energy field around the spark plug gap 94 which can improve ignition by maintaining a stronger electromagnetic field between the center electrode 30 and the ground electrode 504 and decreasing breakdown energy required for a spark event.

The surface treatment 550 decreases the dielectric constant of the base 516, generating a difference in dielectric constant between the main body section 512 and the base 516. For example only, the dielectric constant of the main body section 512 may be approximately 3*10^6 V/m, whereas the dielectric constant of the surface treated (550) ground electrode base 516 may be less than 3*10^6 V/m. The difference in the dielectric constants decreases the chance of the spark shorting into the ground electrode arm 508, thereby increasing the combustion reliability in the combustion chamber. Further, the different dielectric constants create a concentrated ionization energy field around the spark plug gap 94 which can improve ignition by maintaining a stronger electromagnetic field between the center electrode 30 and the ground electrode 504 and decreasing breakdown energy required for a spark event.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A spark plug comprising:
- a housing;
- a center electrode disposed within said housing; and
- a ground electrode cooperating with said center electrode to generate a spark,
- wherein said ground electrode includes:
  - an arm having a main body and a base, said main body being fixed to said housing,
  - a pad fixed to said base, and
  - a covering affixed to at least one of said main body and said base, said covering altering a dielectric strength of said main body or a dielectric strength of said base to create a difference in said dielectric strength of said main body and said dielectric strength of said base and focus said spark on said pad,
  - wherein said covering is a surface treatment or coating of said main body that increases said dielectric strength of said main body.

2. The spark plug of claim 1, wherein said covering is a nonconductive material.

3. The spark plug of claim 1, wherein said covering is one of a ceramic, a polymer, an acrylic, a para-aramid synthetic fiber, a polystyrene, a polytetrafluoroethylene, a polyvinyl chloride, a Bakelite, a nylon, a fused quartz, and an aluminum oxide.

4. The spark plug of claim 1, wherein said covering is a conductive coating on said base that decreases said dielectric strength of said base.

5. The spark plug of claim 4, wherein said conductive coating is a high temperature precious metal.

6. The spark plug of claim 1, wherein said covering is a surface treatment on said base that decreases said dielectric strength of said base.

7. The spark plug of claim 6, wherein said surface treatment is one of a series of bumps, grooves, etches, or scratches.

8. A ground electrode assembly for a spark plug comprising:
- an arm having a main body and a base,
- a pad fixed to said base, and
- a covering affixed to at least one of said main body and said base, said covering altering a dielectric strength of said main body or a dielectric strength of said base to create a difference in said dielectric strength of said main body and said dielectric strength of said base and focus a generated spark on said pad,
- wherein said covering is one of a surface treatment, coating, or sleeve on said main body that increases said dielectric strength of said main body, wherein said dielectric strength of said covering is greater than 3*10^6 V/m and said dielectric strength of said base is within a range of 0 V/m to 3*10^6 V/m, said covering is disposed on said base of said arm, said covering is a coating having a dielectric strength less than 3*10^6 V/m and having a conductivity greater than 18.7*10^6 S/m, or said covering is disposed on said base of said arm and is a surface treatment that decreases said dielectric strength of said base to less than 3*10^6 V/m, said surface treatment being one of a series of bumps, grooves, etches, or scratches.

9. The ground electrode assembly of claim 8, wherein said coating is a high temperature precious metal.

10. A spark plug comprising:
- a housing;
- a center electrode disposed within said housing; and
- a ground electrode cooperating with said center electrode to generate a spark,
- wherein said ground electrode includes:
  - an arm having a main body and a base, said main body being fixed to said housing,
  - a pad fixed to said base, and
  - a covering affixed to at least one of said main body and said base, said covering altering a dielectric strength of said main body or a dielectric strength of said base to create a difference in said dielectric strength of said main body and said dielectric strength of said base and focus said spark on said pad,
  - wherein said covering is a sleeve covering at least a portion of said main body of said arm.

11. The spark plug of claim 10, wherein said sleeve is a nonconductive material.

12. The spark plug of claim 10, wherein said sleeve covers an entirety of said main body.

13. The spark plug of claim 10, wherein said sleeve covers an upper portion of said main body nearest said housing.

14. The spark plug of claim 10, wherein said sleeve covers a lower portion of said main body nearest said base.

* * * * *